US007152699B2

(12) United States Patent
Nordfeldt

(10) Patent No.: US 7,152,699 B2
(45) Date of Patent: Dec. 26, 2006

(54) CONNECTION ROD AND METHOD FOR PRODUCTION THEREOF

(75) Inventor: Leif Nordfeldt, Soderbarke (SE)

(73) Assignee: Atlas Copco Secoroc AB, Fagersta (SE)

( * ) Notice: Subject to any disclaimer, the term of this patent is extended or adjusted under 35 U.S.C. 154(b) by 234 days.

(21) Appl. No.: 10/768,172

(22) Filed: Feb. 2, 2004

(65) Prior Publication Data

US 2004/0226754 A1 Nov. 18, 2004

(30) Foreign Application Priority Data

May 16, 2003 (SE) ..... 0301422

(51) Int. Cl.
*E21B 17/20* (2006.01)

(52) U.S. Cl. ..... 175/320; 175/414

(58) Field of Classification Search ..... 175/320, 175/414; 76/108.2
See application file for complete search history.

(56) References Cited

U.S. PATENT DOCUMENTS

| | | | | |
|---|---|---|---|---|
| 3,295,613 | A * | 1/1967 | Anderson | 173/131 |
| 4,487,357 | A * | 12/1984 | Simon | 228/173.5 |
| 4,710,245 | A * | 12/1987 | Roether | 148/521 |
| 2002/0028121 | A1* | 3/2002 | Jakob et al. | 411/294 |
| 2002/0051695 | A1* | 5/2002 | Friederich et al. | 411/424 |
| 2004/0136776 | A1* | 7/2004 | Kehrer | 403/270 |
| 2005/0067195 | A1* | 3/2005 | Linden | 175/320 |
| 2005/0217901 | A1* | 10/2005 | Hedlund et al. | 175/414 |

* cited by examiner

*Primary Examiner*—William Neuder
(74) *Attorney, Agent, or Firm*—Young & Thompson

(57) ABSTRACT

A connection rod (1) for rock drilling includes a first rod part (2) whidh has an external thread (4) provided at one end thereof, wherein the end of the rod opposite to the one end includes an end portion (6) which carries an internal thread (5), wherein the end portion (6) is joind to the first rod part (2) by friction welding and wherein the end portion (6) has been heat treated prior to being joined to the first rod part (2). The invention also relates to a method of producing such a connection rod.

20 Claims, 2 Drawing Sheets

CONNECTION ROD AND METHOD FOR PRODUCTION THEREOF

BACKGROUND OF THE INVENTION

The present invention relates to a connecting rod of the kind in rock drilling operations, both with regard to underground and surface drilling. The invention also relates to a method of producing such a rod.

When drilling in rock, connecting rods, or extension pieces, are used between drill bit and shank adapter to enable holes of desired depths to be drilled. The rods are connected to one another and to the drill bit and shank adapter by means of screw joints.

The rods are produced in mutually different lengths with regard to underground drilling, normally lengths of up to about 3 m, and up to about 6 m with regard to surface drilling. A typical rod will have an external thread at one end and an internal thread at its other end. The rod is straight between the two threaded ends.

In the case of surface drilling, the connecting rods used are normally in the form of hot-rolled hollow rods which have been surface hardened at their thread-carrying ends. However, it has been found problematic to achieve satisfactory surface hardening of the internal thread, owing to the difficulty in obtaining a uniform profile depth. In the case of underground drilling, it has therefor been preferred to have a case hardened internal thread, which makes it necessary to case harden the entire connecting rod and therewith increase production costs.

SUMMARY OF THE INVENTION

Consequently, an object of the present invention is to provide a novel type of connecting rod with which satisfactory hardening of the internally threaded end can be achieved in particular while still keeping production costs down to a reasonable level.

The object of the invention is achieved with a connecting rod which includes a first part having an external thread at one end and at its opposite end an end portion that carries an internal thread, wherein said end portion is joined to the first rod part by friction welding and wherein said end portion has been heat treated prior to being joined to the first rod part.

According to one preferred embodiment of the invention end portion carrying the internal thread is case hardened.

According to a further embodiment of the invention the first rod part includes an external thread on that end of said rod part located opposite to the end portion carrying said internal thread.

As mentioned in the introduction, one object of the present invention resides in the provision of a method of producing a connection rod according to the present invention.

This object is achieved by the steps of producing a separate end portion that includes an internal thread, heat treating said end portion, and thereafter joining the separately produced end portion with the remainder of the connection rod by friction welding.

According to a preferred embodiment of the inventive method the separately produced end portion is case hardened prior to being joined to the remainder of the connection rod.

BRIEF DESCRIPTION OF THE DRAWINGS

The invention will now be described with reference to a non-limiting example thereof and also with reference to the accompanying drawings, in which.

DESCRIPTION OF THE PREFERRED EMBODIMENTS

Figure 1:
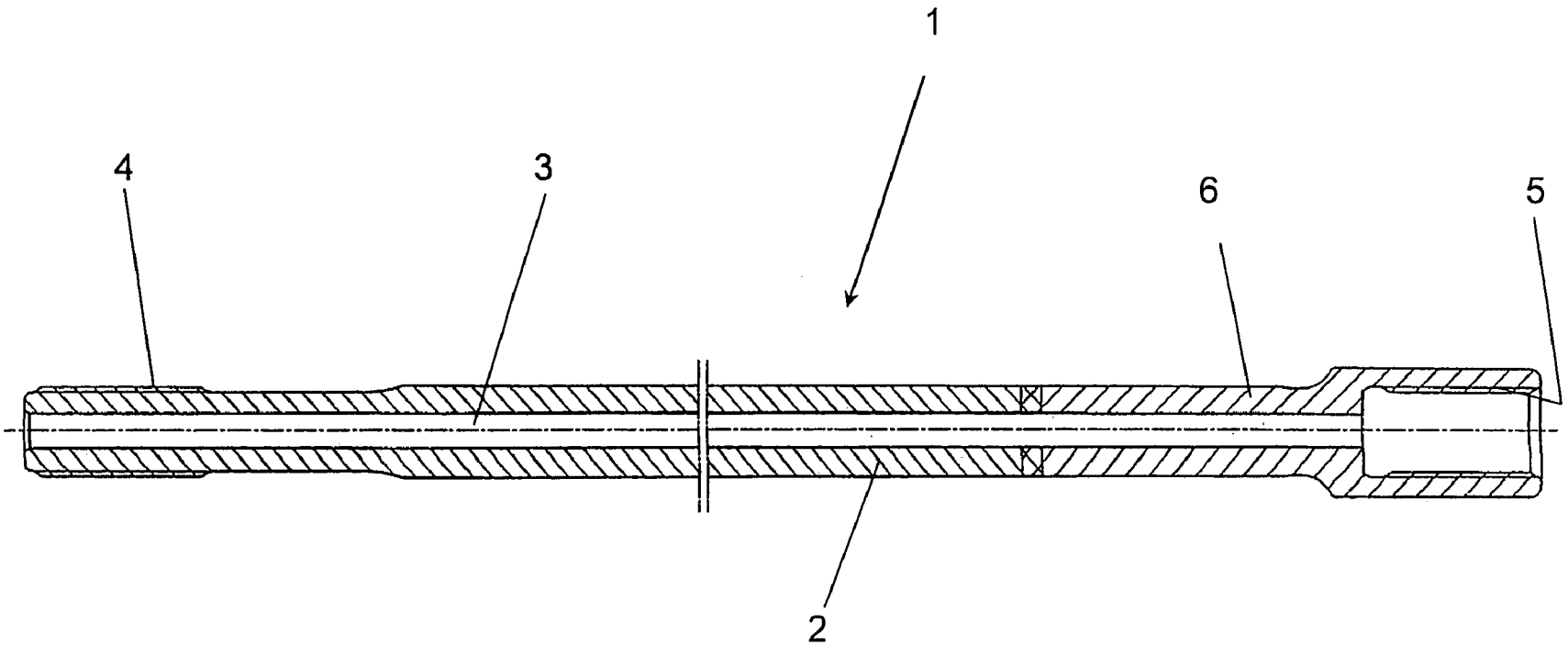
FIG. 1 is a schematic longitudinal sectioned view of a connection rod according to the present invention.
Figure 2:
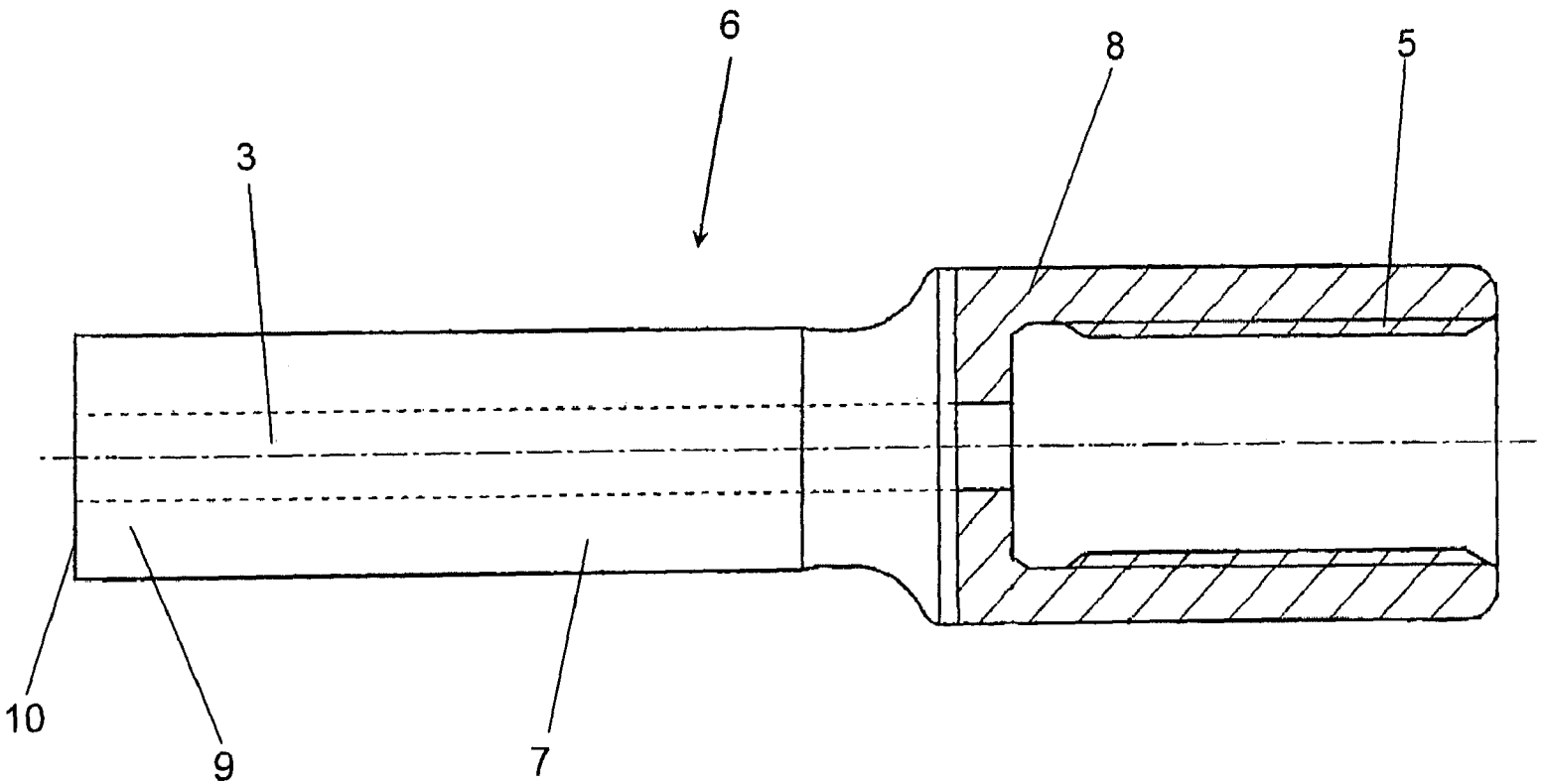
FIG. 2 is a schematic side view, partly in section, of an end portion intended for the inventive connection rod.

The connection rod 1 illustrated in FIG. 1 includes a central section 2 which is formed by a round hot-rolled rod that has a centrally throughpassing hole 3. The rod 1 includes at one end an external thread 4 and at its opposite end an end portion 6 that includes an internal thread 5.

Connecting rods 1 of this design can, in principle, be connected in infinite lengths, by screwing the external thread 4 into an internal thread of another rod.

As will be apparent from FIG. 1, the end portion 6 carrying the internal thread 5 is formed from a material different to that of the remainder of the rod 1. On the other hand, the rod end carrying the external thread is comprised of the same hot-rolled rod as the central section 2 of the connection rod.

Thus, in accordance with the invention, the end portion 6 carrying the internal thread 5 is comprised of a material that is different to the material of said central section 2 and that has been specially heat treated in a way different to that of said central section 2 and thereafter joined to the central section 2 by friction welding.

The heat treatment process to which the end portion 6 is subjected prior to being joined to the central part 2 of the rod is conveniently a case hardening process that will enhance the mechanical strength of the internal thread 5 and the part of the rod joined thereto, i.e. essentially the whole of the end portion 6. The maximum stresses due to the thread connection often occur somewhat inwardly of the actual thread 5, as seen from the adjacent end of the connection rod/the end portion. The heat treated end portion therefore includes a shaft portion 7 that extends somewhat from the expanded part 8 of the end portion, said expanded part 8 including the internal thread 5. Essentially the whole of the end portion 6, including the shaft portion 7, is heat treated/hardened in the same way.

In order to optimise material properties in the friction welding process, it is necessary to exclude the end 9 of the end portion 6 from the case hardening process. The end portion 6 is therefore given a protective coating or covering at the opposite end 9, at a distance from the end surface 10 in a direction towards the expanded part 8, prior to the case hardening process. This protective covering or coating is applied to the actual end surface 10 and to the outside of the shaft part 7 and also to the central throughpassing hole 3 in said shaft part. The protective coating is applied over a distance of 20–50 mm from the end surface 10 and functions to prevent the coated surfaces from taking up carbon during the carbonisation process, this process resulting in a higher surface content of carbon in the end portion 6. It is true that the coated opposite end 9 of the end portion will be hardened to some extent in a following heat treatment process, but no case hardening will take place at this particular part of the end portion 6.

By producing the end portion 6 as a separate part and heating said part per se, there can be produced, in accordance with the invention, an optimised connection rod, where that part of the rod which is most subjected to stress, i.e. the central part 2, and the end of the rod carrying the external thread 4 are also treated per se. For example, the external thread can be heated treated in the manner required, e. g. surface hardened or tough-hardened, whereas the end portion 6 can be case hardened so as to increase its wear strength.

Respective parts 2 and 6 of the connection rod, each having been heat treated per se, are then joined together by friction welding. The thus combined connection rod can then be treated unitarily, for instance shot peening the join area, to enhance its endurance strength, and then straightened and coated. The threads at respective ends of the rod can then be treated to protect against corrosion, in a traditional manner.

As will be understood, after the end portion 6 has been joined to the central part 2 by friction welding it is not necessary to heat treat the final product.

The invention thus provides a connection rod that is optimal in respect of many different applications and that can be used in both underground drilling and in surface drilling and where each respective part of the rod has been adequately heat treated.

As mentioned in the introduction, the invention also relates to a method of producing a connection rod in accordance with the invention. This method will be apparent from the above detailed description of the inventive connection rod.

It will be understood that the internal thread 5 and the external thread 4 can be heat treated in accordance with other appropriate methods than those described above. Despite the possibility of heat treating the various parts of the rod with different methods, an important feature of the invention resides in the ability to achieve such treatment without needing to heat treat the whole of the rod in one and the same way.

The invention claimed is:

1. A connection rod (1) for rock drilling comprising a first rod part (2) which has an external thread (4) provided at one end thereof, characterised in that the end of the rod opposite to said one end includes an end portion (6) which carries an internal thread (5); in that the end portion (6) is made of another material than the material of the first rod part (2); in that the end portion (6) is joined to the first rod part (2) by friction welding; and in that the end portion (6) has been heat treated prior to being joined to the first rod part (2).

2. A connection rod according to claim 1, characterised in that the end portion (6) is case hardened.

3. A connection rod according to claim 1, characterised in that the end portion (6) includes a shaft part (7) that extends away from the internal thread (5), said shaft part being that part of the end portion which has been joined to the first rod part (2).

4. A connection rod according to claim 1, characterised in that the first rod part (2) is comprised of hot rolled rod.

5. A connection rod according to claim 1, characterised in that the external thread (4) provided on said one end is surface hardened.

6. A connection rod according to claim 1, characterised in that the external thread (4) provided on said one end is tempered.

7. A method of producing a connection rod (1) that comprises an external thread (4) at one end, characterised by producing and heat treating a separate end portion (6) that includes an internal thread (5), said separate end portion (6) being made from another material than the material of the remainder (2) of the connection rod, and joining said separate end portion (6) to the remainder of the rod by friction welding.

8. A method according to claim 7, characterised by case hardening the separately produced end portion (6) prior to joining said end portion to the remaining portion (2) of the rod.

9. A method according to claim 7, characterised by providing that part of the end portion (6) lying closest to the end (9) to be joined to the remaining portion (2) of the rod with a protective coating or covering and thereafter case hardening the separately produced end portion (6) prior to joining said end portion to the remaining portion (2) of the rod.

10. A method according to claim 9, characterised by applying said protective coating to the end surface (10) that is to be joined to the remaining portion (2) of the rod, and also to the outer and inner surfaces of the end portion (6) along a distance of 20–50 mm from the end surface (10).

11. A method according to claim 7, characterised by surface hardening the external thread (4).

12. A method according to claim 7, characterised by tempering the external thread (4).

13. The method of claim 7, wherein, the rod part is heat treated in a first way, and the end part is heat treated in a second way, the first and second ways being different.

14. The method of claim 13, wherein, the first way of heat treating is tempering so that the rod part is tempered, the second way of heat treating is case hardening, and a part of the end portion (6) lying closest to an end (9) to be joined to the rod (2) remains free of the case hardening by applying a protective coating or covering and thereafter case hardening the separately produced end portion (6) prior to free welding said end portion to the rod.

15. A connection rod (1) for rock drilling, comprising:

a rod part (2) comprising a first end and an opposite second end;

an external thread (4) at the first end of the rod part;

an end portion (6) joined to the second end of the rod part; and an internal thread (5) carried by the end portion (6), wherein, the first rod part (2) is of a first material and the end portion (6) is of a second material, the first material and the second material being different, and the end portion (6) has been heat treated.

16. The connection rod of claim 15, wherein, the end portion (6) is joined by a friction weld to the second end of the rod part.

17. The connection rod of claim 16, wherein, the rod part is a round hot-rolled rod, a centrally throughpassing hole (3) extends from the external thread (4) to the internal thread (5), and the rod part is heat treated differently from the heat treatment of the end portion.

18. The connection rod of claim 17, wherein, the end portion (6) comprises an expanded part (8) carrying the internal thread (5), a shaft portion (7) connected to an end of the expanded part (8) at a first end and connected to the friction weld at a second end (9), and the expanded part (8), the internal thread (5), and the shaft portion, with the exception of the second end (9), is case hardening, the second end being free of case hardening.

19. The connection rod of claim 16, wherein, the rod part is a round hot-rolled rod, a centrally throughpassing hole (3) extends from the external thread (4) to the internal thread (5), and the rod part is tempered, and the end portion is case hardening.

20. The connection rod of claim 15, wherein, the rod part is a round hot-rolled rod, and further comprising a centrally throughpassing hole (3) extending from the external thread (4) to the internal thread (5).

* * * * *